US006823616B1

(12) United States Patent
Gutter et al.

(10) Patent No.: US 6,823,616 B1
(45) Date of Patent: Nov. 30, 2004

(54) METHOD OF EXCAVATING

(75) Inventors: Arnold Gutter, Assendelft (NL); Dick Korf, Hardinxveld (NL)

(73) Assignee: Boskalis Westminister Inc., Metairie, LA (US)

( * ) Notice: Subject to any disclaimer, the term of this patent is extended or adjusted under 35 U.S.C. 154(b) by 0 days.

(21) Appl. No.: 10/191,396

(22) Filed: Jul. 8, 2002

Related U.S. Application Data

(60) Provisional application No. 60/303,675, filed on Jul. 6, 2001.

(51) Int. Cl.[7] ..... B66C 3/02; E02F 1/00; E02F 3/413

(52) U.S. Cl. ..... 37/461; 37/195; 294/68.23; 701/50

(58) Field of Search ..... 701/50; 172/2; 37/461, 184–188, 195, 466; 294/68.22–68.24

(56) References Cited

U.S. PATENT DOCUMENTS 4,106,225 A * 8/1978 Schnabel, Jr.
6,108,949 A * 8/2000 Singh et al. ..... 37/414

* cited by examiner

*Primary Examiner*—Christopher J. Novosad
(74) *Attorney, Agent, or Firm*—Garvey, Smith, Nehrbass & Doody, L.L.C.; Charles C. Garvey, Jr.; Seth M. Nehrbass

(57) ABSTRACT

A method of excavating a surface layer of soil is disclosed that uses an excavator with a grab having two bucket halves with cutting edge. In a first excavating position, the grab is held in a first orientation as seen in projection on a horizontal plane and inserted into the layer of soil in an open position of the bucket halves until their cutting edges reach a first predetermined level while maintaining the first orientation. While maintaining that level and first orientation, the bucket halves are moved to a closed position during which movement their cutting edges move towards each other through a substantially straight path so as to excavate a first rectangular portion of the layer of soil. The grab is then lifted and moved to a discharge position horizontally spaced from the excavating position and emptied there to make further transport of the excavated soil possible. The grab is moved towards a second excavating position and held in the first orientation and inserted into the layer of soil in an open position of the bucket halves until their cutting edges reach a second predetermined level. While maintaining that level and the first orientation, the bucket halves are moved to a closed position during which movement their cutting edges move towards each other through a substantially straight path so as to excavate a second rectangular portion of the layer of soil, the second portion being adjacent and contiguous to the first portion before excavation. The grab is lifted and moved to a discharge position horizontally spaced from the first and second excavating positions and emptied there to make further transport of the excavated soil possible. This method is repeated in a corresponding manner for excavating subsequent third, fourth, etcetera rectangular portions until the layer of soil is excavated.

55 Claims, 5 Drawing Sheets

METHOD OF EXCAVATING

CROSS-REFERENCE TO RELATED APPLICATIONS

Priority of our U.S. Provisional Application Ser. No. 60/303,675, filed 6 Jul. 2001, incorporated herein by reference, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

This invention relates to a method of excavating a layer of soil by using an excavator comprising a grab with two bucket halves.

2. General Background of the Invention

Excavating methods using a grab are very well-known for excavating soil layers on land or under water.

Soil layers may have to be excavated for various reasons. One reason is that the depth of a water course must be increased. Another, more recent reason is that the soil layer contains contaminated material. In that case care has to be taken that the material of the soil layer is disturbed to a minimal extent, in order to prevent diffusion of the contaminated material into the surrounding water. Usually, contaminated soil layers are relatively thin layers.

In addition, which is true for both land and under-water operation, the amount of removed material must be kept as small as possible.

Furthermore, the excavating process should be as efficient as possible, in order to ensure that the capacity of each excavating cycle is optimal and the required number of movements is kept to a minimum.

Thus, there is a need for an excavating method by which contaminated soil layers can be excavated in a controlled manner.

In addition, there is a need for an efficient excavating method.

Moreover, there is a need for an accurate excavating method for excavating layers of soil material, in particular thin layers of (contaminated or not) material.

Incorporated herein by reference are European Patent No. 067747, its published patent application no. 95200709.4, published on 18 Oct. 1995, and Dutch patent application no. NL 9500450, filed 22 Mar 1994.

SUMMARY OF THE INVENTION

According to one aspect, the invention provides a method of excavating a surface layer of soil by using an excavator comprising a grab having two bucket halves with cutting edges, comprising the steps of:

a) in a first excavating position the grab is held in a first orientation as seen in projection on a horizontal plane and inserted into the layer of soil in an open position of the bucket halves until their cutting edges reach a first predetermined level while maintaining said first orientation, b) while maintaining that level and first orientation, the bucket halves are moved to a closed position during which movement their cutting edges move towards each other through a substantially straight path so as to excavate a first rectangular portion of the layer of soil, c) the grab is lifted and moved to a discharge position horizontally spaced from the excavating position and emptied there to make further transport of the excavated soil possible, d) the grab is moved towards a second excavating position and held in said first orientation and inserted into the layer of soil in an open position of the bucket halves until their cutting edges reach a second predetermined level, e) while maintaining that level and said first orientation, the bucket halves are moved to a closed position during which movement their cutting edges move towards each other through a substantially straight path so as to excavate a second rectangular portion of the layer of soil, said second portion being adjoining to said first portion before excavation, f) the grab is lifted and moved to a discharge position horizontally spaced from the first and second excavating positions and emptied there to make further transport of the excavated soil possible;

whereafter steps d, e and f are repeated in a corresponding manner for excavating subsequent third, fourth, etcetera rectangular portions until the layer of soil is excavated.

Thus it is ensured that a repeated excavating movement on the same spot is avoided to a large extent and any possible overlap can be known and can be kept as small as possible. The grab can be filled with a portion of the layer of soil, the location and orientation of which is known and thus filled to an optimal capacity. The straight closing movement of the cutting edges and the stable holding of the grab during closing and excavating, minimize the risk of spreading soil particles.

Preferably, the excavation is carried out according to a pattern comprised of adjoining, parallel rectangular portions of the layer of soil, wherein said first and second predetermined levels are on a same level or horizontal plane. In this way a horizontal layer or part of such a layer can be removed by moving the grab one pattern step after each excavating cycle.

In an advantageous further development according to the invention, the excavation is carried out according to a pattern comprised of superposed, in projection in a horizontal plane, coinciding rectangular portions of the layer of soil, wherein said first and second levels are different. In this way a vertical column of two or more excavating portions can be removed.

The cutting edges may be moved through a substantially horizontal path during the closing of the bucket halves, so that a horizontal cutting surface is left after an excavating cycle, which permits a reliable estimate of the actual bottom level and of the quantity of soil which is yet to be excavated.

According to a further development, the angle of the grab with respect to the vertical is measured during insertion of the grab into the layer of soil by means of an inclinometer.

In yet a further development of the method according to the invention, a projection of the area to be excavated is entered into a control and monitoring system for the excavating device in the form of a horizontal template of rectangles corresponding to the rectangular portions to be removed by the grab in an excavating step and determining the location of the grab required for each subsequent excavating step. The prosecution of the excavating process can thus be controlled in a positive and therefore reliable manner.

The orientation of said horizontal template may be selected depending on main profiles in the original surface of the layer of soil, such as a bank of a river or canal, or a harbour.

Advantageously, the rectangles are selected to have a length and a width slightly smaller than the span and the width of the grab, so as to enable a slight and known overlap of the area enclosed by the grab and the rectangles of the horizontal template.

In a further development according to the invention the original location and course of the surface of the layer of soil as well as of the desired location and course of the surface to be obtained by excavation of the layer of soil, are entered into said control and monitoring system for the excavating device in respective digital terrain models—such models are known per se in the art—and combined with said horizontal template, the control and monitoring system dividing the area to be excavated into equidistant or parallel and adjacent subareas, each rectangle of the template comprising a plurality of such subareas, and attributing a thickness value to each subarea, said thickness value corresponding to the difference in the levels of the actual surface and the desired surface for that subarea.

Preferably, the control and monitoring system matches a vertical template on the area between the original surface and the desired surface, the vertical template having horizontal grid lines.

According to a further development of the process of the invention the distance between the horizontal grid lines of the vertical template is selected in relation to the volume of the grab divided by the footprint of the grab. The footprint of the grab is the largest surface area of the grab for excavating purposes.

According to a further development of the process of the invention, the control and monitoring system updates the actual level of the surface layer after each excavating cycle by adjusting the level and thickness values for the subareas located in the rectangle concerned in the horizontal template.

According to a further development of the process of the invention, the control and monitoring system shows the actual status of the excavation process for each of the subareas of the rectangles of the horizontal template on a monitor screen. Thus, the operator of the excavator is provided with information about where the grab still has to be moved to and how many times and thus regarding the process of work on a real-time basis.

According to a further development of the process of the invention, the control and monitoring system shows the thickness values in each subarea in hatching, wherein the hatching is a function of the thickness of the layer still to be removed.

In a preferred method according to the invention, the actual position in the world of the grab is determined by a positioning system using local or global coordinate systems, the control and monitoring system being provided with a receiver for use in said positioning system. Preferably, the monitoring of the actual position in the world of the grab is carried out with the aid of a Real Time Kinematic GPS.

According to a further development of the process of the invention, the actual position in the world of a reference point for the excavator is monitored by the control and monitoring system and the position of a grab reference point with respect to the excavator reference point is measured and supplied to the monitor and control system. Advantageously, the grab reference point is selected at the center of the meeting line of the bucket-half edges in closed position. This point is also the centre of the excavating opening of the grab.

According to a further development, the control and monitoring system provides the operator information concerning the position of the rectangle of the horizontal template to which the grab is moved, in particular compares the location of the grab contour or footprint established on the basis of the measured location of the grab reference point with the location of that rectangle and displays the result of that comparison on a monitor screen.

The excavating process is further improved in controllability and accuracy when according to the invention the orientation of the grab in the horizontal and vertical plane is measured and supplied to the monitoring and control system for comparison to the grid orientation. In case the grab is suspended from an arm and boom of the excavator, the orientation of the arm/boom, in the vertical plane relative to a vertical line through the excavator reference point, can be measured and supplied to the monitoring and control system for determining the position of the grab reference point in that vertical plane. Likewise, the orientation of the arm/boom in the horizontal plane relative to the excavator reference point may be measured and supplied to the monitoring and control system for determining the position of the grab in that horizontal plane.

According to a further aspect of the invention, a rotor is used in the connection between the arm/boom of the excavator and the grab and the angle between the grab, in particular a line in a plane of symmetry of the grab, and the arm/boom, considered in a horizontal plane, is measured and supplied to the monitoring and control system for determining the orientation of the grab contour in the horizontal plane.

In one further development of the method according to the invention the excavator is supported on a base plane and the vertical distance from the excavator reference point to the base is entered into the monitoring and control system. Preferably, the orientation of the base plane is measured and the measurements are supplied to the monitoring and control system.

As suggested in the introduction, the excavating may be carried out in a marine environment. This may be done with the excavator positioned on the bank or the shore, the grab arm/boom extending until below the water. Alternatively, the excavator may be positioned on a floating support, such as a barge or a vessel. In that case it is preferred that the soil layer is located below water level.

Rotation of the support about the support reference point in a horizontal plane is measured by a gyro compass, with its measurements supplied to the monitoring and control system for determining the displacement of the grab due to the support rotation.

In case the receiver for the positioning system is located at a distance from the excavator reference point, the location of the excavator reference point relative to the receiver is measured and entered into the control and monitoring system.

The orientation of the base plane in a vertical plane is preferably measured by means of roll and pitch sensors and entered into the control and monitoring system.

From another aspect, the invention provides a method of excavating a surface layer of soil by a using an excavator comprising a grab having two bucket halves with cutting edges, comprising the steps of:

a) matching a horizontal template of parallel and congruent rectangles on the layer to be excavated, each rectangle having a centre;

b) keeping the grab in open position defining a rectangular grab excavating opening having a grab centre;

c) vertically matching the centre of a selected first rectangle and the grab centre and keeping the grab opening in a first orientation parallel to the rectangles of the horizontal template;

d) positively lowering the cutting edges of the bucket halves into the layer of soil until their cutting edges reach a first predetermined level which maintaining said orientation, e) while maintaining that first level and first orientation, moving the bucket halves to a closed position during which movement their cutting edges move towards each other through a substantially straight path so as to excavate a first rectangular portion of the layer of soil, f) lifting the grab and moving the grab to a discharge position horizontally spaced from the excavating position and emptied there to make further transport of the excavated soil possible, g) moving the grab towards a selected second rectangle of said horizontal template and keeping the grab in open position, h) vertically matching the centre of said second rectangle and the grab centre and keeping the grab opening in said first orientation;

i) keeping the grab in said first orientation and lowering it into the layer of soil in an open position of the bucket halves until their cutting edges reach a second predetermined level, j) while maintaining that second level and said first orientation, moving the bucket halves to a closed position during which movement their cutting edges move towards each other through a substantially straight path so as to excavate a second rectangular portion of the layer of soil, k) lifting the grab and moving it to a discharge position horizontally spaced from the first and second rectangles and emptied there to make further transport of the excavated soil possible;

l) repeating step g–k in a corresponding manner for excavating subsequent rectangles of said horizontal template until the layer of soil is excavated.

According to a further development of the process of the invention, said first and second rectangles are horizontally spaced, in particular adjacent to each other.

Alternatively, said first and second rectangles are superposed.

According to a further development of the process of the invention, the rectangles are selected to have a length and a width slightly smaller than the footprint of the grab, so as to permit a slight and known overlap of the area enclosed by the grab and the rectangles of the horizontal template to ensure complete enclosure of the sediment to be removed.

According to a further development of the process of the invention, the original location and course of the surface of the layer of soil as well as of the desired location and course of the surface to be obtained by excavation of the layer of soil are entered into a control and monitoring system for the excavating device in respective digital terrain models and combined with said horizontal template, the control and monitoring system dividing the area to be excavated into equidistant or parallel and adjacent subareas, each rectangle of the template comprising a plurality of such subareas, and attributing a thickness value to each subarea, said thickness value corresponding to the difference in the levels of the actual surface of the desired surface for that subarea.

According to a further development of the process of the invention, the control and monitoring system matches a vertical template on the area between the original surface and the desired surface, the vertical template having horizontal grid lines.

According to a further development of the process of the invention, the distance between the horizontal grid lines of the vertical template are selected in relation to the volume of the grab divided by the span area of the grab.

According to a further development of the process of the invention, the control and monitoring system updates the actual position of the surface layer after each excavating cycle by adjusting the thickness values for the subareas located in the rectangle concerned in the horizontal template.

According to a further development of the process of the invention, the control and monitoring system shows the actual status of the excavation process for each of the subareas of the rectangles of the horizontal template on a monitor screen.

According to a further development of the process of the invention, the control and monitoring system shows the thickness values in each subarea in hatching, wherein the density of the hatching is a function of the thickness of the layers yet to be removed.

According to a further aspect, the invention provides a method of excavating a surface layer of soil by using a excavator comprising a grab with two bucket halves having cutting edges, comprising the steps of:

a) in a first excavating position the grab is held controlled in a first orientation as seen in projection on a horizontal plane and positively lowered into the layer of soil in an open position of the bucket halves until their cutting edges reach a first predetermined level while maintaining said first orientation, b) while maintaining that first level and first orientation, the bucket halves are moved to a closed position during which movement their cutting edges moves towards each other through a substantially straight path so as to excavate a first rectangular portion of the layer of soil, c) the grab is lifted and moved to a discharge position horizontally spaced from the excavating position and emptied there to make further transport of the excavated soil possible, d) the grab is moved towards a second excavating position and held controlled in a second orientation and positively lowered into the layer of soil in an open position of the bucket halves until their cutting edges reach a second predetermined level, e) while maintaining that level and said second orientation, the bucket halves are moved to a closed position during which movement their cutting edges move towards each other through a substantially straight path so as to excavate a second rectangular portion of the layer of soil, f) the grab is lifted and moved to a discharge position horizontally spaced from the first and second excavating positions and emptied there to make further transport of the excavated soil possible;

whereafter steps d, e and f are repeated in a corresponding manner for excavating subsequent third, fourth, etcetera rectangular portions until the layer of soil is excavated.

Thus, the orientation and level of the grab during excavating, is fully controlled.

In a further development this method includes the steps of before step a), matching a horizontal template of congruent rectangles on the layer to be excavated, each rectangle having a centre and keeping the grab in open position defining a rectangular grab excavating opening having a grab centre, in said first excavating position vertically matching the centre of a selected first rectangle and the grab centre and keeping the grab opening in said first orientation during the lowering and closing of the cutting edges; and in said second excavating position vertically matching the centre of a selected second rectangle and the grab centre and keeping the grab opening in said second orientation during the lowering and closing of the cutting edges.

In this approach, the template can be composed of rectangles that are parallel to each other and/or arranged perpendicular to each other, or otherwise, such according to a radially oriented array.

BRIEF DESCRIPTION OF THE DRAWINGS

Below, the invention will be described on the basis of exemplary embodiment of a method according to the invention.

DESCRIPTION OF THE DRAWINGS

Figure 1A:
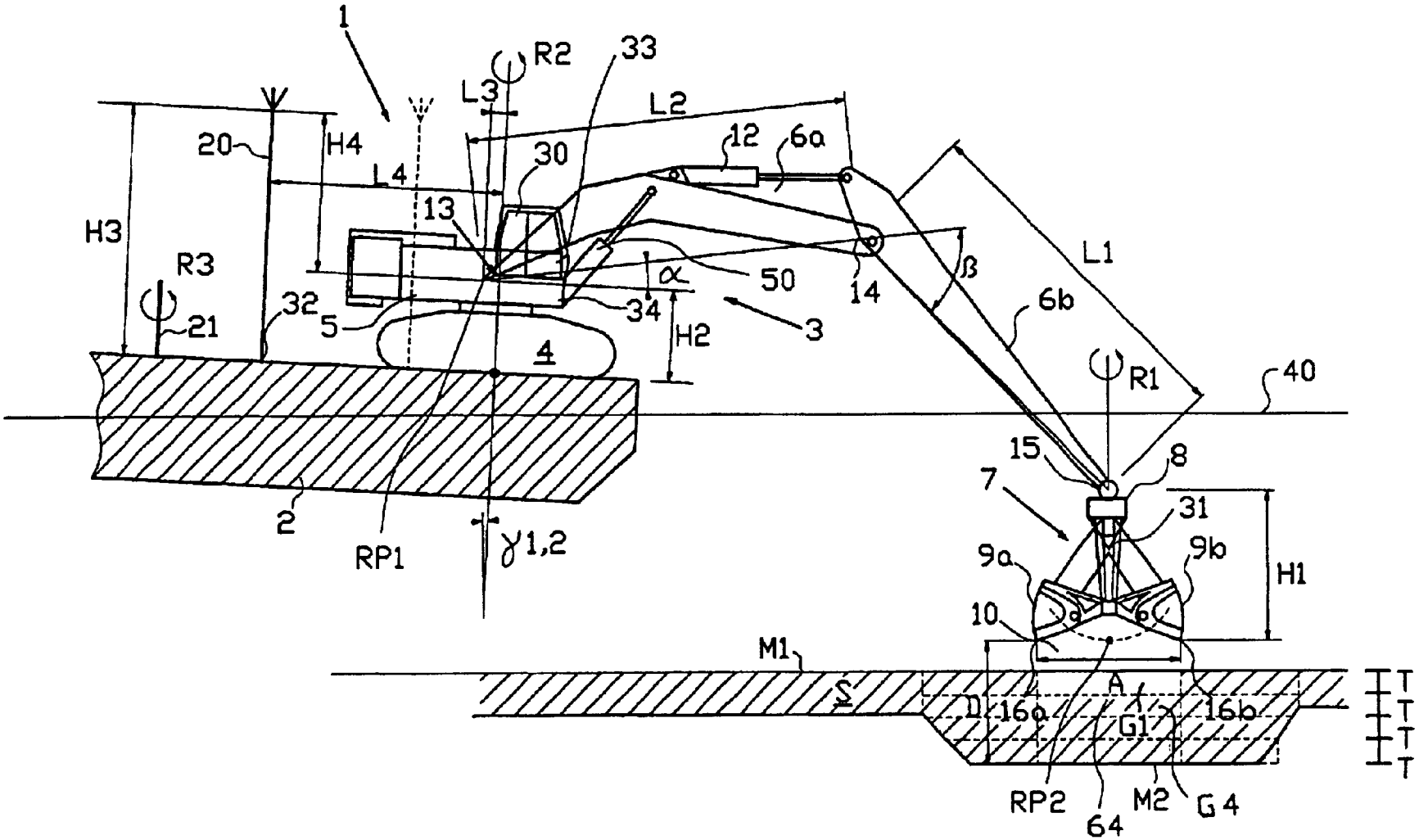
FIG. 1A shows a schematic side view on a part of a system of a barge and an excavator provided with a grab, floating on a water body above a soil layer to be removed.

In the example of the figures, the excavator system 1 is a dredge system 1 and comprises a barge 2 floating on water 40 and which can be positioned and oriented relative to the ground by means of separate systems not shown, such as anchors, wires and winches, spud carriers or a propeller. A hydraulic excavator 3 of the grab type with super structure 5 including a motor compartment and an operator compartment is positioned on the deck of the barge 2, and can be moved thereon by means of its tracks 4. The tracks 4 can be disengaged so a to positively maintain a selected position of the excavator 3 on the barge 2.

The superstructure 5 can rotate about axis R2 (king pin axis) with respect to the substructure including the tracks 4. A boom 6*a* is hinged to the superstructure 5 at horizontal hinge axis 13 on its proximal end and to grab arm 6*b* at horizontal hinge axis 14. A schematically shown hydraulic cylinder 12 is provided to set the angle between the boom 6*a* and the arm 6*b*.

The lower end of the arm 6*b* is connected at 15 to the upper end of a grab 7. The grab 7 has a rotor 8 to permit controlled rotation and adjustment of the grab 7 about axis R1. The grab 7 has two bucket halves 9*a*, 9*b* which are shown in the full open position, in which their cutting edges 16*a*, 16*b* define an excavating opening 10 with a span length A. A grab similar to this grab 7 is disclosed in applicant's European patent application 95.200709, the contents of which are herewith included by reference thereto. The footprint of the grab, when the bucket halves 9*a, b* are fully opened, can be 4.5 m×2 m, for instance.

At the centre of the line of contact of the cutting edges 16*a, b*, when the bucket halves are in the closed position, a grab reference point RP2 is defined. RP2 is located in a same plane as the cutting edges 16*a, b* when these edges are in the fully open position of the grab, depicted in FIG. 1A, in which the distance of these edges is A.

The grab 7 can be provided with an inclinometer 31 for measuring the angle in a vertical plane (parallel to the plane of drawing and/or parallel to a plane perpendicular thereto).

The barge 2 is provided with a measuring device 32 for real time measurement of the pitch and roll ($\gamma$–1 and $\gamma$–2, respectively) of the barge 2. In addition, a gyro compass 21 is provided on the barge 2 for real time measurement the orientation of the barge 2 in the world. Furthermore, an antenna/receiver 20 for an RTK GPS is arranged on deck of the barge 2 to receive information concerning the accurate position in the vertical as well as in the horizontal plane.

The operator compartment of the excavator 3 is provided with a monitoring and control computer system 30 and a display screen 33 for the operator. The computer system receives the real time measuring signals from the pitch and roll measuring device 32, the gyro compass 21 and the antenna 20. In addition, the computer system receives real time data concerning the angle $\alpha$ between a first line through hinges 13 and 14 and the plane of the deck and the angle $\beta$ between a second line through hinge 14 and connection 15 and said first line, all measured in a plane perpendicular to the support plane of the barge 2.

In addition, the computer system receives real time data concerning the rotational position of the superstructure 5 relative to the tracks 4.

The computer system 30 is provided with an entry device 34 for inputting data concerning the length L1 of the arm 6*b*, the length L2 of the boom 6*b*, the distance L4 between the antenna 20 and the hinge 13 (excavator reference point RP1), as well as the distance L3 between point 13 and the king pin axis.

Furthermore, the vertical distance H1 between the grab reference point RP2 and the connection point 15, the distance H2 between the deck and the hinge 13 and the distance H3 between the deck and the antenna 20 is inputted in the computer system.

As a consequence, the computer system can determine real time the precise location in X, Y and Z of the grab reference point RP2—via RP1—with respect to the ground, as well as the possible inclination of the grab opening.

Alternatively, the receiver 20 can be located somewhere in the king pin axis. In addition, it is possible to use an excavator in which the axis 13 is located in the king pin axis.

Figure 3A:
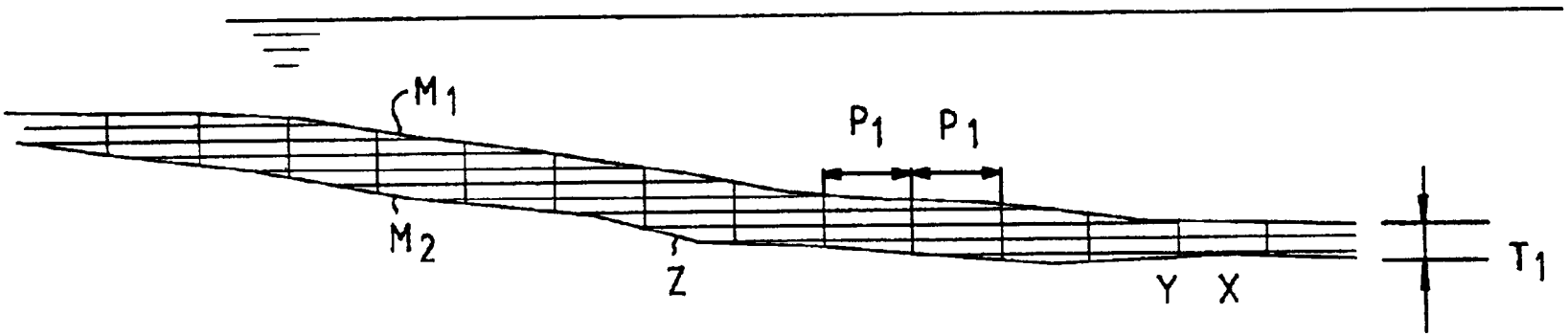
FIGS. 3A, 3B, 3C and 3D show consecutive stages of the method according to the invention in the excavation of a sediment layer.
Figure 3C:
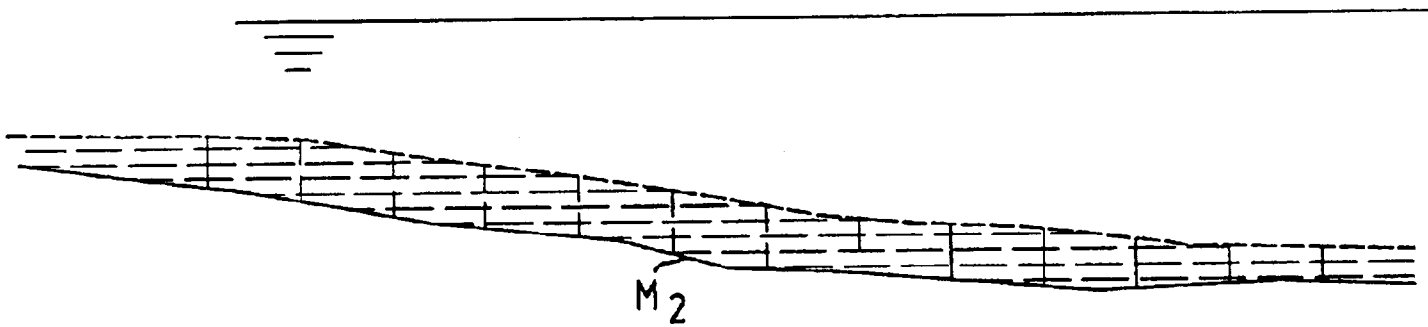
Figures 3B, 3D:
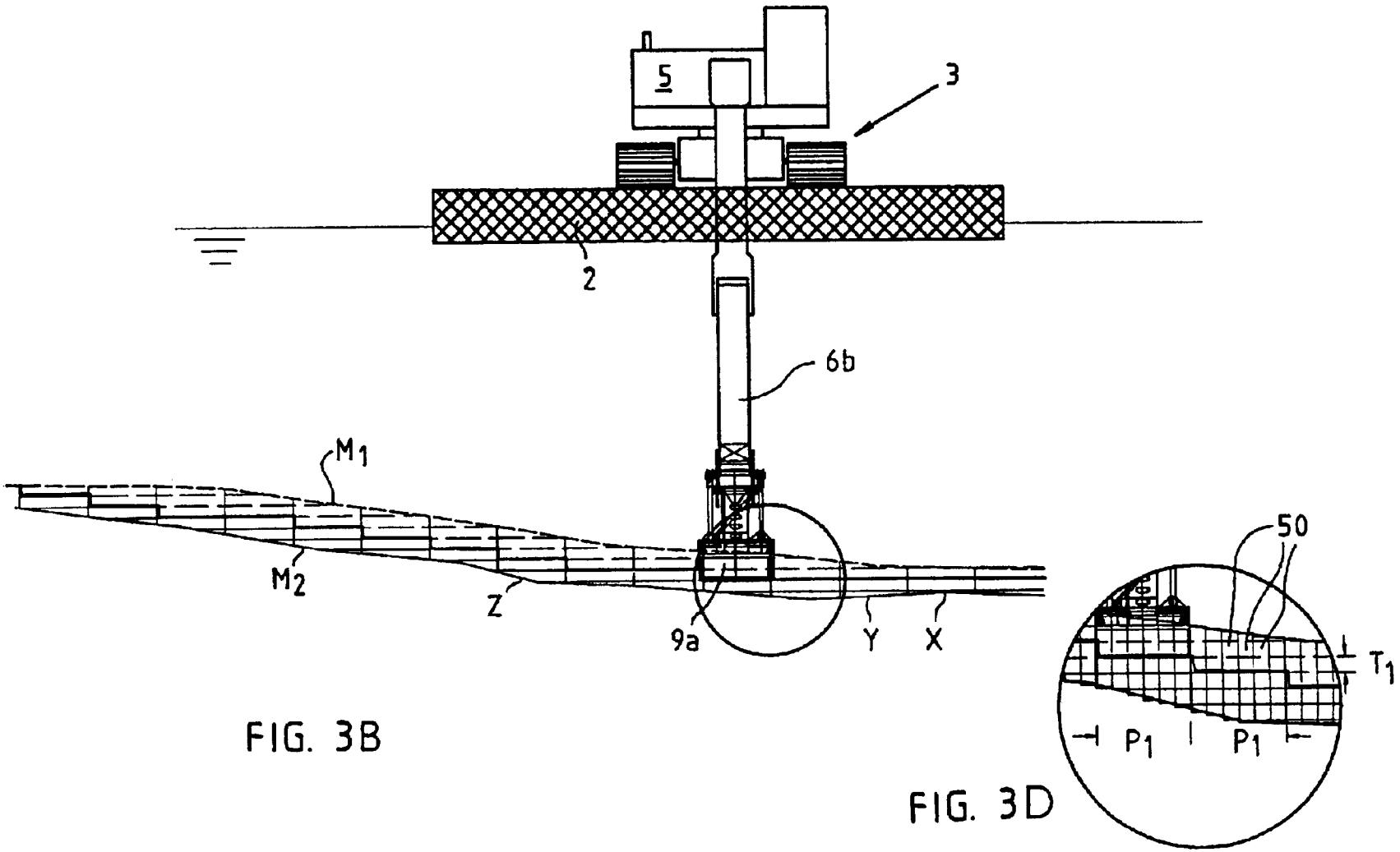

In FIG. 1A, the contaminated sediment layer S to be removed is depicted. The original surface is M1, and the desired surface (to be realized by excavating) is M2. The position and level of M1 and M2 is established by any suitable means known in the art, such as by precise hydrographic survey methods. The orientation of the models M1 and M2 can be fixed and be N–S or W–E. The data of M1 and M2 are stored in the computer system 30 in the form of digital terrain models. By way of example, these models are composed of area cells 50 (vide FIG. 3D) of 30 cm×30 cm, each cell being attributed a measured value of level of original surface and level of desired surface. In addition, these cells are divided vertically into units of 30 cm height (in this example), vide FIG. 3D. This will be elucidated below.

Figure 2:
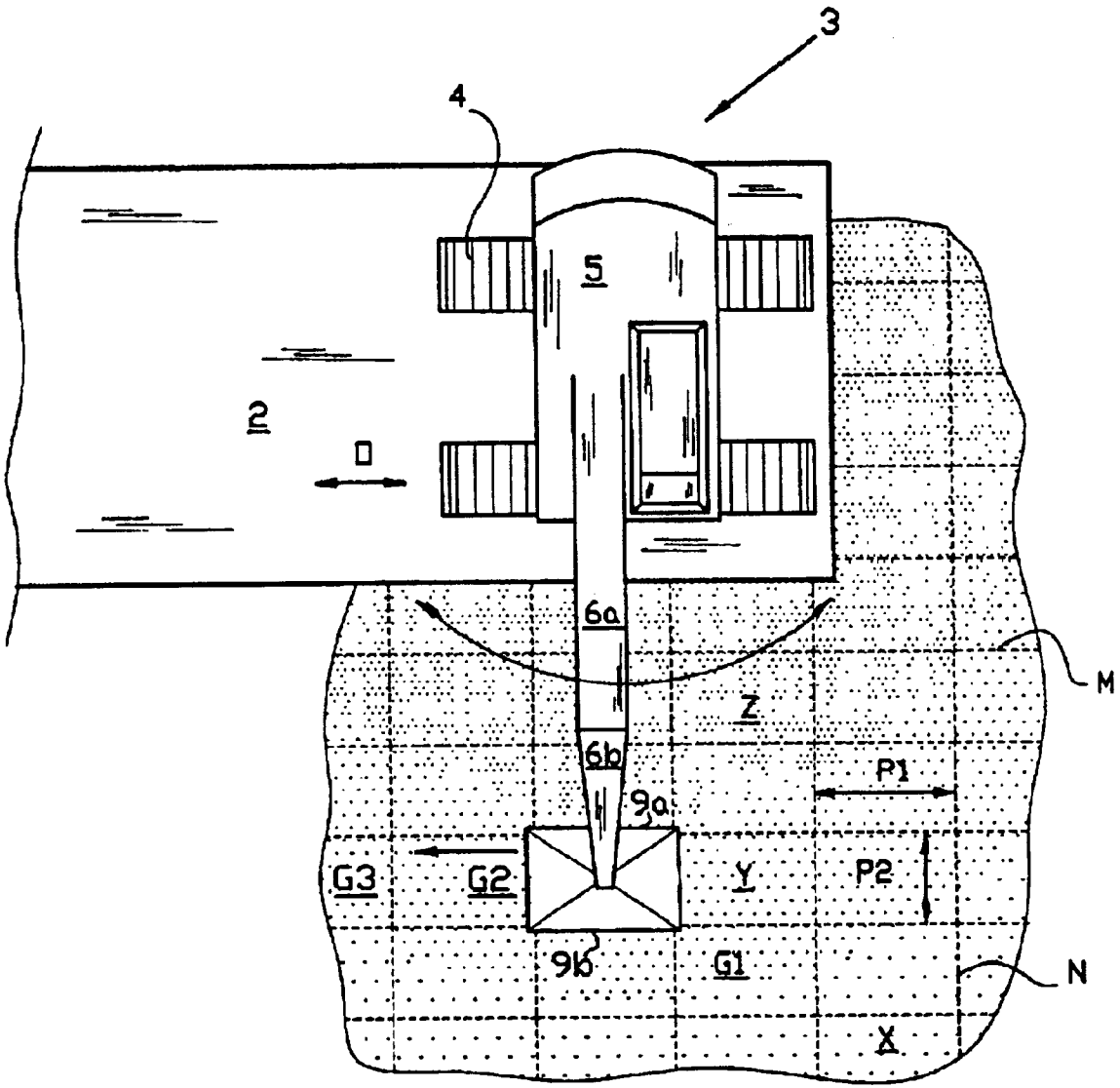
FIG. 2 shows a schematic top view on the arrangement of FIG. 1A.

As can be seen in FIG. 2, the area to be dredged is divided according to a horizontal template composed of rectangles G1, G2, G3, etcetera, defined by equidistant and parallel lines M and equidistant and parallel lines N perpendicular thereto. The orientation of the lines M (or N) is selected in accordance with the physical circumstances at the location concerned. In this example, a bank or slope extending parallel to lines M may be present. It is remarked that the rectangles may be arranged according to other patterns, like a pattern in which the even rows are shifted over half a length with respect to the uneven rows. In the computer system 30 the data of the terrain models M1 and M2 are matched to the horizontal template.

The length of a rectangle is P1, and the width P2. These dimensions are chosen in relation to the footprint or span of the grab bucket halves 9*a, b*, such that the length A and width of the footprint are somewhat larger than P1 and P2, respectively, for instance by half a cell dimension on both sides (thus in total one cell size in each orthogonal direction).

As can be seen in FIGS. 1 and 3A–D, a division in vertical sense has been made in steps of thickness T of —in this example—30 cm. This step is chosen to be equal to the excavating contents of the grab in closed condition divided by the footprint and multiplied by a safety factor less than 1. Thus, as can be derived from FIG. 3A, in location X the excavation of two layers will be required, whereas in location Z the excavation of at least 5 layers will be necessary to reach M2.

All these data have been entered into the computer system 30.

In use, the operator starts with the excavation of rectangle G1 (FIG. 1A), by manoeuvring the grab 7 so that the RP2 is directly above the centre of the rectangle G1, with fully opened bucket halves 9*a, b*. The operator is able to see the relative positions of RP2 and the centre of the rectangle G1 on the display 33.

When RP2 coincides with the centre of G1 the operator lowers the grab so as to let the cutting edges 16*a, b* penetrate into the soil, until RP2 is at a level of M1 minus T, which the operator can verify on the display 33. In this process, RP2 is moved vertically. Then, the operator closes the cutting edges 16*a, b* towards each other, during which they follow a substantially horizontally path. In doing this, the point 15 is kept at a constant level.

When the grab 7 is closed, the grab 7 is lifted and the superstructure 5 is rotated about R2 to bring the grab 7 to a discharge location to empty it's contents. The next step may be to bring the grab 7 above G1 again and lower it in the excavated recess, to repeat the cycle in order to remove the soil in rectangle G4, which has a thickness of T also. Alternatively, the grab 7 can be moved to a rectangle horizontally spaced from G1, such as adjacent rectangle G2 (FIG. 2). The process can then be repeated. In that case there will be question of a specifically defined overlap, since the footprint is larger than the rectangles G1,2 etcetera. This overlap is chosen in relation to the accuracy of the measuring process (M1, M2, GPS, etcetera) and of the grab positioning process.

The movement of the grab is closed, a signal is supplied to the computer system 30 that at that location a layer of thickness T has been removed. The computer system adds this information to the actual digital terrain model in order to update the difference in level for the cells present in the rectangle concerned. In accordance therewith, the computer system adapts the display on the screen 33, which can be done by T-stepwise altering the intensity of the colour (for instance 1T is light, 5T is dark). As shown in FIG. 2, it is also possible to modify the density of dots or hatching, few dots indicating 2T (X), more dots indicating 3T (Y) and the largest density of dots indicating 5T (Z).

The operator can monitor the excavating process on his screen, choosing the most appropriate location for the next grab, by taking into account the required movement of the barge 2, the properties of the soil, current, etcetera. The history is stored and processed in the computer system, so that the operator is presented the real time condition of the sediment surface at any time.

Thus a fully controllable grab with a positively known cutting edge position and movement is combined with a terrain model and a precisely functioning positioning system in order to permit the excavation of a layer of soil according to a most efficient profile, at a correct and controlled depth. Thus, an optimal filling of the grab with a minimum of water can be realized. Due to the known and controllable minimal overlap the removal of the layer of soil can take place in a highly efficient manner. Spill and turbidity are kept to a minimum.

Figure 1B:
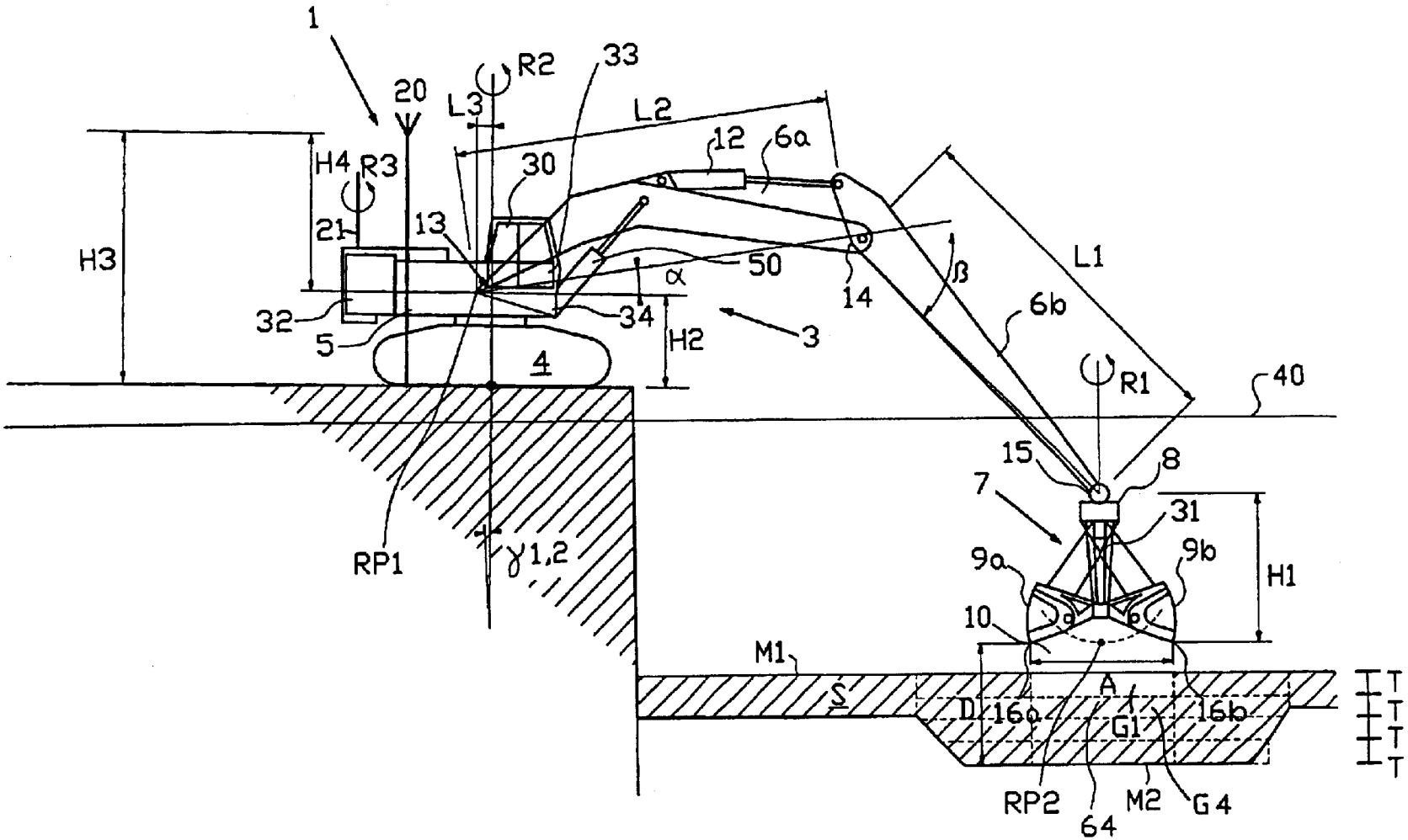
FIG. 1B shows a schematic side view on a part of a system almost similar to that of FIG. 1A, the excavator being supported on a quay.

FIG. 1B is similar to FIG. 1A to a large extent, so that like parts and elements have the same reference numerals. The difference is that the excavator 1 is positioned ashore, such as on a quay 102 and that the antenna 20, the roll and pitch measurement device and the gyro compass 21 are positioned on the excavator 1. Consequently the distance L4 will be constant.

It is to be understood that the above description is included to illustrate the operation of the preferred embodiments and is not meant to limit the scope of the invention. The scope of the invention is to be limited only by the following claims. From the above discussion, many variations will be apparent to one skilled in the art that would yet be encompassed by the spirit and scope of the present invention.

What is claimed is:

1. A method of excavating a surface layer of soil by using an excavator comprising a grab having two bucket halves, each grab having a cutting edge, comprising the steps of:

a) controlling the grab to hold the grab in a first orientation in a first excavating position as seen in projection on a horizontal plane and inserted into the layer of soil in an open position of the bucket halves until their cutting edges reach a first predetermined level while maintaining said first orientation;

b) while maintaining that level and first orientation, the bucket halves are moved to a closed position during which movement their cutting edges move towards each other through a substantially straight path so as to excavate a first rectangular portion of the layer of soil;

c) the grab is lifted and moved to a discharge position horizontally spaced from the excavating position and emptied there to make further transport of the excavated soil possible;

d) the grab is moved towards a second excavating position and held in said first orientation and inserted into the layer of soil in an open position of the bucket halves until their cutting edges reach a second predetermined level;

e) while maintaining that level and said first orientation, the bucket halves are moved to a closed position during which movement their cutting edges move towards each other through a substantially straight path so as to excavate a second rectangular portion of the layer of soil, said second portion being adjacent to said first portion before excavation;

f) the grab is lifted and moved to a discharge position horizontally spaced from the first and second excavating positions and emptied there to make further transport of the excavated soil possible; and g) whereafter steps d, e and f are repeated in a corresponding manner for excavating subsequent third, fourth, etcetera rectangular portions until the layer of soil is excavated.

2. The method according to claim 1, wherein the excavation is carried out according to a pattern comprising a sequence of adjoining, parallel rectangular portions of the layer of soil, wherein said first and second predetermined levels are on a horizontal plane.

3. The method according to claim 1, wherein the cutting edges are moved through a substantially horizontal path during the closing of the bucket halves.

4. The method according to claim 1, wherein a projection of the area to be excavated is entered into a control and monitoring system for the excavating system in the form of a horizontal template of rectangles corresponding to the rectangular portions to be removed by the grab in an excavating step and determining the location of the grab required for each subsequent excavating step.

5. The method according to claim 1, wherein the soil layer is located under water.

6. A method of excavating a surface layer of soil by using an excavator comprising a grab having two bucket halves, each grab having a cutting edge, comprising the steps of:

a) controlling the grab to hold the grab in a first orientation in a first excavating position as seen in projection on a horizontal plane and inserted into the layer of soil in an open position of the bucket halves until their cutting edges reach a first predetermined level while maintaining said first orientation;

b) while maintaining that level and first orientation, the bucket halves are moved to a closed position during which movement their cutting edges move towards each other through a substantially straight path so as to excavate a first rectangular portion of the layer of soil;

c) the grab is lifted and moved to a discharge position horizontally spaced from the excavating position and emptied there to make further transport of the excavated soil possible;

d) the grab is moved towards a second excavating position and held in said first orientation and inserted into the layer of soil in an open position of the bucket halves until their cutting edges reach a second predetermined level;

e) while maintaining that level and said first orientation, the bucket halves are moved to a closed position during which movement their cutting edges move towards each other through a substantially straight path so as to excavate a second rectangular portion of the layer of soil, said second portion being adjacent to said first portion before excavation;

f) the grab is lifted and moved to a discharge position horizontally spaced from the first and second excavating positions and emptied there to make further transport of the excavated soil possible;

g) whereafter steps d, e and f are repeated in a corresponding manner for excavating subsequent third, fourth, etcetera rectangular portions until the layer of soil is excavated; and h) wherein the excavation is carried out according to a pattern comprised of a sequence of superposed, in projection in a horizontal plane coinciding rectangular portions of the layer of soil, wherein said first and second predetermined levels are on a different level.

7. A method of excavating a surface layer of soil by using an excavator comprising a grab having two bucket halves, each grab having a cutting edge, comprising the steps of:

a) controlling the grab to hold the grab in a first orientation in a first excavating position as seen in projection on a horizontal plane and inserted into the layer of soil in an open position of the bucket halves until their cutting edges reach a first predetermined level while maintaining said first orientation;

b) while maintaining that level and first orientation, the bucket halves are moved to a closed position during which movement their cutting edges move towards each other through a substantially straight path so as to excavate a first rectangular portion of the layer of soil;

c) the grab is lifted and moved to a discharge position horizontally spaced from the excavating position and emptied there to make further transport of the excavated soil possible;

d) the grab is moved towards a second excavating position and held in said first orientation and inserted into the layer of soil in an open position of the bucket halves until their cutting edges reach a second predetermined level;

e) while maintaining that level and said first orientation, the bucket halves are moved to a closed position during which movement their cutting edges move towards each other through a substantially straight path so as to excavate a second rectangular portion of the layer of soil, said second portion being adjacent to said first portion before excavation;

f) the grab is lifted and moved to a discharge position horizontally spaced from the first and second excavating positions and emptied there to make further transport of the excavated soil possible;

g) whereafter steps d, e and f are repeated in a corresponding manner for excavating subsequent third, fourth, etcetera rectangular portions until the layer of soil is excavated; and h) wherein the angle of the grab with respect to the vertical is measured during insertion of the grab into the layer of soil by means of an inclinometer.

8. A method of excavating a surface layer of soil by using an excavator comprising a grab having two bucket halves, each grab having a cutting edge, comprising the steps of:

a) controlling the grab to hold the grab in a first orientation in a first excavating position as seen in projection on a horizontal plane and inserted into the layer of soil in an open position of the bucket halves until their cutting edges reach a first predetermined level while maintaining said first orientation;

b) while maintaining that level and first orientation, the bucket halves are moved to a closed position during which movement their cutting edges move towards each other through a substantially straight path so as to excavate a first rectangular portion of the layer of soil;

c) the grab is lifted and moved to a discharge position horizontally spaced from the excavating position and emptied there to make further transport of the excavated soil possible;

d) the grab is moved towards a second excavating position and held in said first orientation and inserted into the layer of soil in an open position of the bucket halves until their cutting edges reach a second predetermined level;

e) while maintaining that level and said first orientation, the bucket halves are moved to a closed position during which movement their cutting edges move towards each other through a substantially straight path so as to excavate a second rectangular portion of the layer of soil, said second portion being adjacent to said first portion before excavation;

f) the grab is lifted and moved to a discharge position horizontally spaced from the first and second excavating positions and emptied there to make further transport of the excavated soil possible;

g) whereafter steps d, e and f are repeated in a corresponding manner for excavating subsequent third, fourth, etcetera rectangular portions until the layer of soil is excavated;

h) wherein a projection of the area to be excavated is entered into a control and monitoring system for the excavating system in the form of a horizontal template of rectangles corresponding to the rectangular portions to be removed by the grab in an excavating step and determining the location of the grab required for each subsequent excavating step; and i) wherein the orientation of said horizontal template is selected depending on main profiles in the original surface of the layer of soil.

9. A method of excavating a surface layer of soil by using an excavator comprising a grab having two bucket halves, each grab having a cutting edge, comprising the steps of:

a) controlling the grab to hold the grab in a first orientation in a first excavating position as seen in projection on a horizontal plane and inserted into the layer of soil in an open position of the bucket halves until their cutting edges reach a first predetermined level while maintaining said first orientation;

b) while maintaining that level and first orientation, the bucket halves are moved to a closed position during which movement their cutting edges move towards each other through a substantially straight path so as to excavate a first rectangular portion of the layer of soil;

c) the grab is lifted and moved to a discharge position horizontally spaced from the excavating position and emptied there to make further transport of the excavated soil possible;

d) the grab is moved towards a second excavating position and held in said first orientation and inserted into the layer of soil in an open position of the bucket halves until their cutting edges reach a second predetermined level;

e) while maintaining that level and said first orientation, the bucket halves are moved to a closed position during which movement their cutting edges move towards each other through a substantially straight path so as to excavate a second rectangular portion of the layer of soil, said second portion being adjacent to said first portion before excavation;

f) the grab is lifted and moved to a discharge position horizontally spaced from the first and second excavating positions and emptied there to make further transport of the excavated soil possible;

g) whereafter steps d, e and f are repeated in a corresponding manner for excavating subsequent third, fourth, etcetera rectangular portions until the layer of soil is excavated;

h) wherein a projection of the area to be excavated is entered into a control and monitoring system for the excavating system in the form of a horizontal template of rectangles corresponding to the rectangular portions to be removed by the grab in an excavating step and determining the location of the grab required for each subsequent excavating step; and i) wherein the rectangles are selected to have a length and a width slightly smaller than the footprint of the grab, so as to enable a slight and known overlap of the area enclosed by the grab and the rectangular portions of the horizontal template.

10. The method according to claim 9, wherein the control and monitoring system matches a vertical template on the area between the original surface and the desired surface, the vertical template having horizontal grid lines.

11. The method according to claim 9, wherein the control and monitoring system updates the actual position of the surface layer after each excavating cycle by adjusting the level and thickness values for the subareas located in the rectangle concerned in the horizontal template.

12. The method according to claim 9, wherein the control and monitoring system shows the actual status of the excavation process for each of the subareas of the rectangular portions of the horizontal template on a monitor screen present on the excavator.

13. The method according to claim 12, wherein the control and monitoring system shows the thickness values in each subarea in hatching, wherein the density of the hatching is a function of the thickness of the layers still to be removed.

14. A method of excavating a surface layer of soil by using an excavator comprising a grab having two bucket halves, each grab having a cutting edge, comprising the steps of:

a) controlling the grab to hold the grab in a first orientation in a first excavating position as seen in projection on a horizontal plane and inserted into the layer of soil in an open position of the bucket halves until their cutting edges reach a first predetermined level while maintaining said first orientation;

b) while maintaining that level and first orientation, the bucket halves are moved to a closed position during which movement their cutting edges move towards each other through a substantially straight path so as to excavate a first rectangular portion of the layer of soil;

c) the grab is lifted and moved to a discharge position horizontally spaced from the excavating position and emptied there to make further transport of the excavated soil possible;

d) the grab is moved towards a second excavating position and held in said first orientation and inserted into the layer of soil in an open position of the bucket halves until their cutting edges reach a second predetermined level;

e) while maintaining that level and said first orientation, the bucket halves are moved to a closed position during which movement their cutting edges move towards each other through a substantially straight path so as to excavate a second rectangular portion of the layer of soil, said second portion being adjacent to said first portion before excavation;

f) the grab is lifted and moved to a discharge position horizontally spaced from the first and second excavating positions and emptied there to make further transport of the excavated soil possible;

g) whereafter steps d, e and f are repeated in a corresponding manner for excavating subsequent third, fourth, etcetera rectangular portions until the layer of soil is excavated;

h) wherein a projection of the area to be excavated is entered into a control and monitoring system for the excavating system in the form of a horizontal template of rectangles corresponding to the rectangular portions to be removed by the grab in an excavating step and determining the location of the grab required for each subsequent excavating step; and i) wherein the original location and course of the surface of the layer of soil as well as of the desired location and course of the surface to be obtained by excavation of the layer of soil are entered into said control and monitoring system for the excavating device in the form of respective digital terrain models and combined with said horizontal template, the control and monitoring system dividing the area to be excavated into equidistant or parallel and adjacent subareas, each rectangle of the template comprising a plurality of such subareas or cells, and attributing a thickness value to each subarea, said thickness value corresponding to the difference in the levels of the actual surface and the desired surface for that subarea.

15. The method according to claim 14 wherein the distance between the horizontal grid lines of the vertical template is selected in relation to the volume of the grab divided by the footprint of the grab.

16. A method of excavating a surface layer of soil by using an excavator comprising a grab having two bucket halves, each grab having a cutting edge, comprising the steps of:

a) controlling the grab to hold the grab in a first orientation in a first excavating position as seen in projection on a horizontal plane and inserted into the layer of soil in an open position of the bucket halves until their cutting edges reach a first predetermined level while maintaining said first orientation;

b) while maintaining that level and first orientation, the bucket halves are moved to a closed position during which movement their cutting edges move towards each other through a substantially straight path so as to excavate a first rectangular portion of the layer of soil;

c) the grab is lifted and moved to a discharge position horizontally spaced from the excavating position and emptied there to make further transport of the excavated soil possible;

d) the grab is moved towards a second excavating position and held in said first orientation and inserted into the layer of soil in an open position of the bucket halves until their cutting edges reach a second predetermined level;

e) while maintaining that level and said first orientation, the bucket halves are moved to a closed position during which movement their cutting edges move towards each other through a substantially straight path so as to excavate a second rectangular portion of the layer of soil, said second portion being adjacent to said first portion before excavation;

f) the grab is lifted and moved to a discharge position horizontally spaced from the first and second excavating positions and emptied there to make further transport of the excavated soil possible;

g) whereafter steps d, e and f are repeated in a corresponding manner for excavating subsequent third, fourth, etcetera rectangular portions until the layer of soil is excavated; and h) wherein the actual position in the world of the grab is determined by a positioning system using local or global coordinate systems, the control and monitoring system being provided with a receiver for use in said positioning system.

17. The method according to claim 16, wherein the monitoring of the actual position in the world of the grab is carried out with the aid of a Real Time Kinematic GPS.

18. The method according to claim 17, wherein the actual position in the world of an excavator reference point for the excavator is monitored by the control and monitoring system and the position of a grab reference point with respect to the excavator reference point is measured and supplied to the monitor and control system.

19. The method according to claim 18, wherein the grab reference point is selected at the centre of the meeting line of the bucket halve edges in closed position.

20. The method according to claim 18, wherein the control and monitoring system provides the operator information concerning the position of the rectangle of the horizontal template to which the grab is moved, in particular compares the location of the grab contour or footprint established on the basis of the measured position of the grab reference point with the location of that rectangle and displays the result of that comparison on a monitor screen.

21. The method according to claim 18, wherein the excavator is positioned on a base plane and the vertical distance from the excavator reference point to the base is entered into the monitoring and control system.

22. The method according to claim 21, wherein the orientation of the base plane is measured and the measurements are supplied to the monitoring and control system.

23. The method according to claim 21, wherein the excavator is supported on a floating support, such as a barge or a vessel.

24. The method according to claim 23, wherein rotation of the support about the support reference point in a horizontal plane is measured by a gyro compass and its measurements are supplied to the monitoring and control system for determining the displacement of the grab due to the support rotation.

25. The method according to claim 24, wherein the receiver for the positioning system is located at a distance from the excavator reference point, and wherein the location of the excavator reference point relative to the receiver is measured and entered into the control and monitoring system.

26. The method according to claim 23, wherein the orientation of the base plane of the floating support in a vertical plane is measured by means of barge trim sensors and entered into the control and monitoring system.

27. The method according to claim 21, wherein the excavator is supported on shore.

28. The method according to claim 27, wherein the excavator has a substructure supported on the shore and wherein the orientation of the substructure in a vertical plane is measured by means of pitch and roll sensors and entered into the control and monitoring system.

29. A method of excavating a surface layer of soil by using an excavator comprising a grab having two bucket halves, each grab having a cutting edge, comprising the steps of:

a) controlling the grab to hold the grab in a first orientation in a first excavating position as seen in projection on a horizontal plane and inserted into the layer of soil in an open position of the bucket halves until their cutting edges reach a first predetermined level while maintaining said first orientation;

b) while maintaining that level and first orientation, the bucket halves are moved to a closed position during which movement their cutting edges move towards each other through a substantially straight path so as to excavate a first rectangular portion of the layer of soil;

c) the grab is lifted and moved to a discharge position horizontally spaced from the excavating position and emptied there to make further transport of the excavated soil possible;

d) the grab is moved towards a second excavating position and held in said first orientation and inserted into the layer of soil in an open position of the bucket halves until their cutting edges reach a second predetermined level;

e) while maintaining that level and said first orientation, the bucket halves are moved to a closed position during which movement their cutting edges move towards each other through a substantially straight path so as to excavate a second rectangular portion of the layer of soil, said second portion being adjacent to said first portion before excavation;

f) the grab is lifted and moved to a discharge position horizontally spaced from the first and second excavating positions and emptied there to make further transport of the excavated soil possible;

g) whereafter steps d, e and f are repeated in a corresponding manner for excavating subsequent third, fourth, etcetera rectangular portions until the layer of soil is excavated; and h) wherein the orientation of the grab in the horizontal and in the vertical plane is measured and supplied to the monitoring and control system for comparison to the grid orientation.

30. A method of excavating a surface layer of soil by using an excavator comprising a grab having two bucket halves, each grab having a cutting edge, comprising the steps of:

a) controlling the grab to hold the grab in a first orientation in a first excavating position as seen in projection on a horizontal plane and inserted into the layer of soil in an open position of the bucket halves until their cutting edges reach a first predetermined level while maintaining said first orientation;

b) while maintaining that level and first orientation, the bucket halves are moved to a closed position during which movement their cutting edges move towards each other through a substantially straight path so as to excavate a first rectangular portion of the layer of soil;

c) the grab is lifted and moved to a discharge position horizontally spaced from the excavating position and emptied there to make further transport of the excavated soil possible;

d) the grab is moved towards a second excavating position and held in said first orientation and inserted into the layer of soil in an open position of the bucket halves until their cutting edges reach a second predetermined level;

e) while maintaining that level and said first orientation, the bucket halves are moved to a closed position during which movement their cutting edges move towards each other through a substantially straight path so as to excavate a second rectangular portion of the layer of soil, said second portion being adjacent to said first portion before excavation;

f) the grab is lifted and moved to a discharge position horizontally spaced from the first and second excavating positions and emptied there to make further transport of the excavated soil possible;

g) whereafter steps d, e and f are repeated in a corresponding manner for excavating subsequent third, fourth, etcetera rectangular portions until the layer of soil is excavated; and h) wherein the grab is suspended from an arm/boom of the excavator and the orientation of the arm/boom, in the vertical plane relative to a vertical line through the excavator reference point, is measured and supplied to the monitoring and control system for determining the position of the grab reference point in that vertical plane.

31. A method of excavating a surface layer of soil by using an excavator comprising a grab having two bucket halves, each grab having a cutting edge, comprising the steps of:

a) controlling the grab to hold the grab in a first orientation in a first excavating position as seen in projection on a horizontal plane and inserted into the layer of soil in an open position of the bucket halves until their cutting edges reach a first predetermined level while maintaining said first orientation;

b) while maintaining that level and first orientation, the bucket halves are moved to a closed position during which movement their cutting edges move towards each other through a substantially straight path so as to excavate a first rectangular portion of the layer of soil;

c) the grab is lifted and moved to a discharge position horizontally spaced from the excavating position and emptied there to make further transport of the excavated soil possible;

d) the grab is moved towards a second excavating position and held in said first orientation and inserted into the layer of soil in an open position of the bucket halves until their cutting edges reach a second predetermined level;

e) while maintaining that level and said first orientation, the bucket halves are moved to a closed position during which movement their cutting edges move towards each other through a substantially straight path so as to excavate a second rectangular portion of the layer of soil, said second portion being adjacent to said first portion before excavation;

f) the grab is lifted and moved to a discharge position horizontally spaced from the first and second excavating positions and emptied there to make further transport of the excavated soil possible;

g) whereafter steps d, e and f are repeated in a corresponding manner for excavating subsequent third, fourth, etcetera rectangular portions until the layer of soil is excavated; and h) wherein the orientation of the arm/boom in the horizontal plane relative to the excavator reference point, is measured and supplied to the monitoring and control system for determining the position of the grab in that horizontal plane.

32. The method according to claim 31, wherein a rotor is used in the connection between the arm/boom of the excavator and the grab and the angle between the grab, in particular a line in a plane of symmetry of the grab, and the arm/boom, considered in a horizontal plane, is measured and supplied to the monitoring and control system for determining the orientation of the grab contour in the horizontal plane.

33. A method of excavating a surface layer of soil by a using an excavator comprising a grab with two bucket halves having cutting edges, comprising the steps of:

a) matching a horizontal template of parallel and congruent rectangles on the layer to be excavated, each rectangle having a centre;

b) keeping the grab in open position defining a rectangular grab excavating opening having a grab centre, c) vertically matching the centre of a selected first rectangle and the grab centre and keeping the grab opening in a first orientation parallel to the rectangular portions of the horizontal template;

d) positively lowering the cutting edges of the bucket halves into the layer of soil until their cutting edges reach a first predetermined level while maintaining said orientation, e) while maintaining that first level and first orientation, moving the bucket halves to a closed position during which movement their cutting edges move towards each other through a substantially straight path so as to excavate a first rectangular portion of the layer of soil, f) lifting the grab and moving the grab to a discharge position horizontally spaced from the excavating position and emptied there to make further transport of the excavated soil possible, g) moving the grab towards a selected second rectangle of said horizontal template and keeping the grab in open position, h) vertically matching the centre of said second rectangle and the grab centre and keeping the grab opening in said first orientation;

i) keeping the grab in said first orientation and lowering it into the layer of soil in an open position of the bucket halves until their cutting edges reach a second predetermined level, j) while maintaining that second level and said first orientation, moving the bucket halves to a closed position during which movement their cutting edges move towards each other through a substantially straight path so as to excavate a second rectangular portion of the layer of soil, k) lifting the grab and moving it to a discharge position horizontally spaced from the first and second rectangles and emptied there to make further transport of the excavated soil possible;

l) repeating steps g–k in a corresponding manner for excavating subsequent rectangles of said horizontal template until the layer of soil is excavated.

34. The method according to claim 33, wherein said first and second rectangles are horizontally spaced.

35. The method according to claim 34, wherein said first and second rectangles are adjacent to each other.

36. The method according to claim 33, wherein said first and second rectangles are superposed.

37. The method according to claim 33, wherein the rectangles are selected to have a length and a width slightly smaller than that of the footprint of the grab, so as to permit a slight and known overlap of the area enclosed by the grab and the rectangular portions of the horizontal template.

38. The method according to claim 37, wherein the original location and course of the surface of the layer of soil as well as the desired location and course of the surface to be obtained by excavation of the layer of soil are entered into a control and monitoring system for the excavating device in respective digital terrain models and combined with said horizontal template, the control and monitoring system dividing the area to be excavated into equidistant or parallel and adjacent subareas, each rectangle of the template comprising a plurality of such subareas, and attributing a thickness value to each subarea, said thickness value corresponding to the difference in the levels of the actual surface and the desired surface for that subarea.

39. The method according to claim 38, wherein the control and monitoring system matches a vertical template on the area between the original surface and the desired surface, the vertical template having horizontal grid lines.

40. The method according to claim 39, wherein the distance between the horizontal grid lines of the vertical template are selected in relation to the volume of the grab divided by the footprint of the grab.

41. The method according to claim 38, wherein the control and monitoring system updates the actual position of the surface layer after each excavating cycle by adjusting the level and thickness values for the subareas located in the rectangle concerned in the horizontal template.

42. The method according to claim 38, wherein the control and monitoring system shows the actual status of the excavation process for each of the subareas of the rectangular portions of the horizontal template on a monitor screen present on the grab.

43. The method according to claim 42, wherein the control and monitoring system shows the thickness values in each subarea in hatching, wherein the density of the hatching is a function of the thickness of the layers yet to be removed.

44. A method of excavating a surface layer of soil by using an excavator comprising a grab having two bucket halves with cutting edges, comprising the steps of:

a) holding the grab in a first orientation in a first excavating position as seen in projection on a horizontal plane and positively lowered into the layer of soil in an open position of the bucket halves until their cutting edges reach a first predetermined level while maintaining said first orientation;

b) while maintaining that first level and first orientation, the bucket halves are moved to a closed position during which movement their cutting edges move towards each other through a substantially straight path so as to excavate a first rectangular portion of the layer of soil;

c) the grab is lifted and moved to a discharge position horizontally spaced from the excavating position and emptied there to make further transport of the excavated soil possible;

d) the grab is moved towards a second excavating position and held controlled in a second orientation and positively lowered into the layer of soil in an open position of the bucket halves until their cutting edges reach a second predetermined level;

e) while maintaining that level and said second orientation, the bucket halves are moved to a closed position during which movement their cutting edges move towards each other through a substantially straight path so as to excavate a second rectangular portion of the layer of soil;

f) the grab is lifted and moved to a discharge position horizontally spaced from the first and second excavating positions and emptied there to make further transport of the excavated soil possible; and g) whereafter steps d, e and f are repeated in a corresponding manner for excavating subsequent third, fourth, etcetera rectangular portions until the layer of soil is excavated.

45. The method according to claim 44, wherein said first and second rectangular portions form part of a horizontal template of rectangles oriented according to two axes perpendicular to each other.

46. The method according to claim 45, wherein said first and second rectangular portions form part of a horizontal template of parallel rectangles.

47. A method of excavating a surface layer of soil by using an excavator comprising a grab having two bucket halves with cutting edges, comprising the steps of:

a) holding the grab in a first orientation in a first excavating position as seen in projection on a horizontal plane and positively lowered into the layer of soil in an open position of the bucket halves until their cutting edges reach a first predetermined level while maintaining said first orientation;

b) while maintaining that first level and first orientation, the bucket halves are moved to a closed position during which movement their cutting edges move towards each other through a substantially straight path so as to excavate a first rectangular portion of the layer of soil;

c) the grab is lifted and moved to a discharge position horizontally spaced from the excavating position and emptied there to make further transport of the excavated soil possible;

d) the grab is moved towards a second excavating position and held controlled in a second orientation and positively lowered into the layer of soil in an open position of the bucket halves until their cutting edges reach a second predetermined level;

e) while maintaining that level and said second orientation, the bucket halves are moved to a closed position during which movement their cutting edges move towards each other through a substantially straight path so as to excavate a second rectangular portion of the layer of soil;

f) the grab is lifted and moved to a discharge position horizontally spaced from the first and second excavating positions and emptied there to make further transport of the excavated soil possible;

g) whereafter steps d, e and f are repeated in a corresponding manner for excavating subsequent third, fourth, etcetera rectangular portions until the layer of soil is excavated; and h) including the steps of before step a), matching a horizontal template of congruent rectangles on the layer to be excavated, each rectangle having a centre and keeping the grab in open position defining a rectangular grab excavating opening having a grab centre, in said first excavating position vertically matching the centre of a selected first rectangle and the grab centre and keeping the grab opening in said first orientation during the lowering and closing of the cutting edges; and in said second excavating position vertically matching the centre of a selected second rectangle and the grab centre and keeping the grab opening in said second orientation during the lowering and closing the cutting edges.

48. A method of excavating a surface layer of soil by using an excavator comprising a grab having two bucket halves with cutting edges, comprising the steps of:

a) holding the grab in a first orientation in a first excavating position as seen in projection on a horizontal plane and positively lowered into the layer of soil in an open position of the bucket halves until their cutting edges reach a first predetermined level while maintaining said first orientation;

b) while maintaining that first level and first orientation, the bucket halves are moved to a closed position during which movement their cutting edges move towards each other through a substantially straight path so as to excavate a first rectangular portion of the layer of soil;

c) the grab is lifted and moved to a discharge position horizontally spaced from the excavating position and emptied there to make further transport of the excavated soil possible;

d) the grab is moved towards a second excavating position and held controlled in a second orientation and positively lowered into the layer of soil in an open position of the bucket halves until their cutting edges reach a second predetermined level;

e) while maintaining that level and second orientation, the bucket halves are moved to a closed position during which movement their cutting edges move towards each other through a substantially straight path so as to excavate a second rectangular portion of the layer of soil;

f) the grab is lifted and moved to a discharge position horizontally spaced from the first and second excavating positions and emptied there to make further transport of the excavated soil possible;

g) whereafter steps d, e and f are repeated in a corresponding manner for excavating subsequent third, fourth, etcetera rectangular portions until the layer of soil is excavated; and h) wherein said first and second rectangular portions of said template are oriented towards one or more central points.

49. A method of excavating a surface layer of soil by using an excavator comprising a grab having two bucket halves with cutting edges, comprising the steps of:

a) holding the grab in a first orientation in a first excavating position as seen in projection on a horizontal plane and positively lowered into the layer of soil in an open position of the bucket halves until their cutting edges reach a first predetermined level while maintaining said first orientation;

b) while maintaining that first level and first orientation, the bucket halves are moved to a closed position during which movement their cutting edges move towards each other through a substantially straight path so as to excavate a first rectangular portion of the layer of soil;

c) the grab is lifted and removed to a discharge position horizontally spaced from the excavating position and emptied there to make further transport of the excavated soil possible;

d) the grab is moved towards a second excavating position and held controlled in a second orientation and positively lowered into the layer of soil in an open position of the bucket halves until their cutting edges reach a second predetermined level;

e) while maintaining that level and said second orientation, the bucket halves are moved to a closed position during which movement their cutting edges move towards each other through a substantially straight path so as to excavate a second rectangular portion of the layer of soil;

f) the grab is lifted and moved to a discharge position horizontally spaced from the first and second excavating positions and emptied there to make further transport of the excavated soil possible;

g) whereafter steps d, e and f are repeated in a corresponding manner for excavating subsequent third, fourth, etcetera rectangular portions until the layer of soil is excavated; and h) wherein the rectangles are selected to have a length and a width slightly smaller than that of the footprint of the grab, so as to permit a slight and known overlap of the area enclosed by the grab and the rectangular portions of the horizontal template.

50. A method of excavating a surface layer of soil by using an excavator comprising a grab having two bucket halves with cutting edges, comprising the steps of:

a) holding the grab in a first orientation in a first excavating position as seen in projection on a horizontal plane and positively lowered into the layer of soil in an open position of the bucket halves until their cutting edges reach a first predetermined level while maintaining said first orientation;

b) while maintaining that first level and first orientation, the bucket halves are moved to a closed position during which movement their cutting edges move towards each other through a substantially straight path so as to excavate a first rectangular portion of the layer of soil;

c) the grab is lifted and moved to a discharge position horizontally spaced from the excavating position and emptied there to make further transport of the excavated soil possible;

d) the grab is moved towards a second excavating position and held controlled in a second orientation and positively lowered into the layer of soil in an open position of the bucket halves until their cutting edges reach a second predetermined level;

e) while maintaining that level and said second orientation, the bucket halves are moved to a closed position during which movement their cutting edges move towards each other through a substantially straight path so as to excavate a second rectangular portion of the layer of soil;

f) the grab is lifted and moved to a discharge position horizontally spaced from the first and second excavating positions and emptied there to make further transport of the excavated soil possible;

g) whereafter steps d, e and f are repeated in a corresponding manner for excavating subsequent third, fourth, etcetera rectangular portions until the layer of soil is excavated; and h) wherein the original location and course of the surface of the layer of soil as well as of the desired location and course of the surface to be obtained by excavation of the layer of soil are entered into a control and monitoring system for the excavating device in respective digital terrain models and combined with said horizontal template, the control and monitoring system dividing the area to be excavated into equidistant or parallel and adjacent subareas, each rectangle of the template comprising a plurality of such subareas, and attributing a thickness value to each subarea, said thickness value corresponding to the difference in the levels of the actual surface and the desired surface for that subarea.

51. The method according to claim 50, wherein the control and monitoring system matches a vertical template on the area between the original surface and the desired surface, the vertical template having horizontal grid lines.

52. The method according to claim 51, wherein the distance between the horizontal grid lines of the vertical template are selected in relation to the volume of the grab divided by the footprint of the grab.

53. The method according to claim 50, wherein the control and monitoring system updates the actual position of the surface layer after each excavating cycle by adjusting the level and thickness values for the subareas located in the rectangle concerned in the horizontal template.

54. The method according to claim 50, wherein the control and monitoring system shows the actual status of the excavation process for each of the subareas of the rectangular portions of the horizontal template on a monitor screen present on the grab.

55. The method according to claim 54, wherein the control and monitoring system shows the thickness values in each subarea in hatching, wherein the density of the hatching is a function of the thickness of the layers yet to be removed.

* * * * *